US006249993B1

(12) United States Patent
Armstrong et al.

(10) Patent No.: US 6,249,993 B1
(45) Date of Patent: Jun. 26, 2001

(54) TRENCHER ASSEMBLY UTILIZING A DIRECT DRIVE MOTOR

(75) Inventors: Eric A. Armstrong, Plainfield; Mark R. Kinder, Indianapolis, both of IN (US); Alessandro Magliulo; Henry Torosyan, both of Apex, NC (US)

(73) Assignee: Caterpillar S.A.R.L., Geneva (CH)

( * ) Notice: Subject to any disclaimer, the term of this patent is extended or adjusted under 35 U.S.C. 154(b) by 0 days.

(21) Appl. No.: 09/409,651

(22) Filed: Oct. 1, 1999

(51) Int. Cl.[7] ..... E02F 9/20
(52) U.S. Cl. ..... 37/361
(58) Field of Search ..... 37/352, 355, 363, 37/349, 465, 462, 463, 464, 142.5, 361, 362

(56) References Cited

U.S. PATENT DOCUMENTS

| | | | | |
|---|---|---|---|---|
| 2,710,466 | | 6/1955 | Chartier | 37/90 |
| 3,754,341 | | 8/1973 | Caldwell et al. | 37/86 |
| 4,327,508 | | 5/1982 | Youngers | 37/86 |
| 4,483,084 | | 11/1984 | Caldwell et al. | 37/86 |
| 4,660,306 | * | 4/1987 | Bruce et al. | 37/86 |
| 4,750,280 | | 6/1988 | Dalaine | 37/86 |
| 4,794,708 | | 1/1989 | Schroeder et al. | 37/86 |
| 4,833,797 | * | 5/1989 | Slunecka et al. | 37/86 |
| 4,890,399 | * | 1/1990 | Stiff et al. | 37/86 |
| 4,987,689 | * | 1/1991 | Kaczmarski et al. | 37/195 |
| 5,033,214 | * | 7/1991 | Kaczmarski et al. | 37/81 |
| 5,189,817 | * | 3/1993 | Schroeder | 37/86 |
| 5,228,221 | * | 7/1993 | Hillard et al. | 37/355 |
| 5,245,769 | | 9/1993 | Wammock | 37/357 |

* cited by examiner

*Primary Examiner*—Victor Batson
(74) *Attorney, Agent, or Firm*—Diana L. Charlton

(57) ABSTRACT

The present invention includes a trencher assembly with a motor that directly drives a sprocket through the rotation of a shaft of the motor. The rotation of the sprocket drives both a digging chain and an auger assembly simultaneously. The ability to use a motor to directly drive the sprocket decreases the components necessary for a drive train of the trencher assembly to promote a compact design. This occurs because the sprocket is able to drive both the digging chain and auger assembly through the transfer of driving forces from the motor without any intermediate gearing, belts, rotating support structure, and the like.

11 Claims, 8 Drawing Sheets

TRENCHER ASSEMBLY UTILIZING A DIRECT DRIVE MOTOR

TECHNICAL FIELD

This invention relates generally to a trencher assembly and more particularly to the direct drive of the trencher assembly via a motor for improved functionality and simpler overall design.

BACKGROUND ART

Present work machines, such as skid steer loaders and the like, utilize various implements, such as hydraulically operated trencher assembly. Typically, the trencher assembly has a digging boom connected to the machine for pivotal movement. A digging chain is rotatably mounted on the boom and driven for digging in the ground, and an auger is provided which disperses the spoil that is dug during the trenching operation to the sides of the trench.

A problem with known trencher assemblies relates to the complexity of the drive trains for the digging chain and spoil dispersing auger. Generally, the drive assembly for the chain and auger are separate and include a plurality of sprockets, belts, chains, drive shafts, and the like. The drive assemblies are complex and, in some instances, uncovered which permits dirt and debris to enter between the moving parts thereby causing jamming or failure of the various external bearings. Therefore, there is a need for an improved drive train assembly for the digging chain and spoil dispersing auger of the trencher assembly which is compact and fully covered to prevent the entry of debris and the like into the moving parts.

An approach for improving the drive train assembly is disclosed in U.S. Pat. No. 4,327,508 issued to Stephen A. Youngers on May 4, 1982. This patent utilizes a trenching machine with a totally enclosed drive train assembly for the digging chain drive sprocket and spoil dispersing auger. The drive train assembly is totally enclosed and includes a hydraulic motor, a rotatable drive sprocket-hub subassembly, a planetary gearbox, and a boom lift casting. The planetary gearbox and hydraulic motor are mounted on opposite sides of the boom lift casting, and are drivingly interconnected by a drive shaft that passes through the casting. The digging chain drive sprocket subassembly is rotatably mounted by bearings within a hub on the boom lift casting adjacent the planetary gearbox. The digging chain drive sprocket assembly includes a sprocket that is connected to the planetary gearbox through the hub. Additionally, an auger is connected to the gearbox opposite the digging chain drive sprocket assembly. Therefore, the digging chain drive sprocket assembly and auger are driven in unison by the hydraulic motor through the rotation of the gearbox. The separation of the hydraulic motor from the planetary gearbox increase the complexity of this design. This is most evident by the separate hub and sprocket of the digging chain drive sprocket subassembly. The hub includes the bearings to drive the digging chain drive sprocket and the sprocket is interconnected with the hub to drive a respective digging chain. The usage of a separate sprocket and hub and, further, the usage of the bearing within the hub increase the components required to drive the trencher. Therefore, it is desired that a totally enclosed drive train assembly be provided with a simple design that reduces components. Further, the design should directly drive both the digging chain drive sprocket assembly and auger from the motor to increase the compactness of the design.

The present invention is directed to overcoming the problems as set forth above.

DISCLOSURE OF THE INVENTION

In one aspect of the present invention, a trencher assembly comprises a frame. A boom arm is connected on the frame. A motor is connected on the frame and has a rotatable shaft. A sprocket is connected on the shaft of the motor. The sprocket is directly driven by the motor through the rotation of the shaft. A digging chain is connected between the boom arm and the sprocket and is driven by the rotation of the sprocket. An auger assembly is connected to the sprocket for rotation therewith in unison with the digging chain.

In another aspect of the present invention, a trencher assembly has a pivotable boom arm connected to a work machine, a digging chain rotatably connected on the boom arm, and an auger assembly. The trencher assembly comprises an enclosed drive train assembly. The drive train assembly includes a motor with a rotatable shaft and a sprocket for simultaneously driving the digging chain and auger assembly in unison. The sprocket is connected on the shaft of the motor and is directly driven by the motor through the rotation of the shaft. The sprocket includes a gear portion and a hub portion integral with the gear portion.

The present invention includes a trencher assembly with a motor that directly drives a sprocket through the rotation of a shaft of the motor. The rotation of the sprocket drives both a digging chain and an auger assembly. The ability to use a motor to directly drive the sprocket decreases the components necessary for the drive train of the trencher assembly. The reduction in components promotes a compact trencher assembly. This occurs because the sprocket is able to drive both the digging chain and auger through the transfer of driving forces from the motor without any intermediate gearing, belts, rotating support structure, and the like.

BEST MODE FOR CARRYING OUT THE INVENTION

Figure 1:
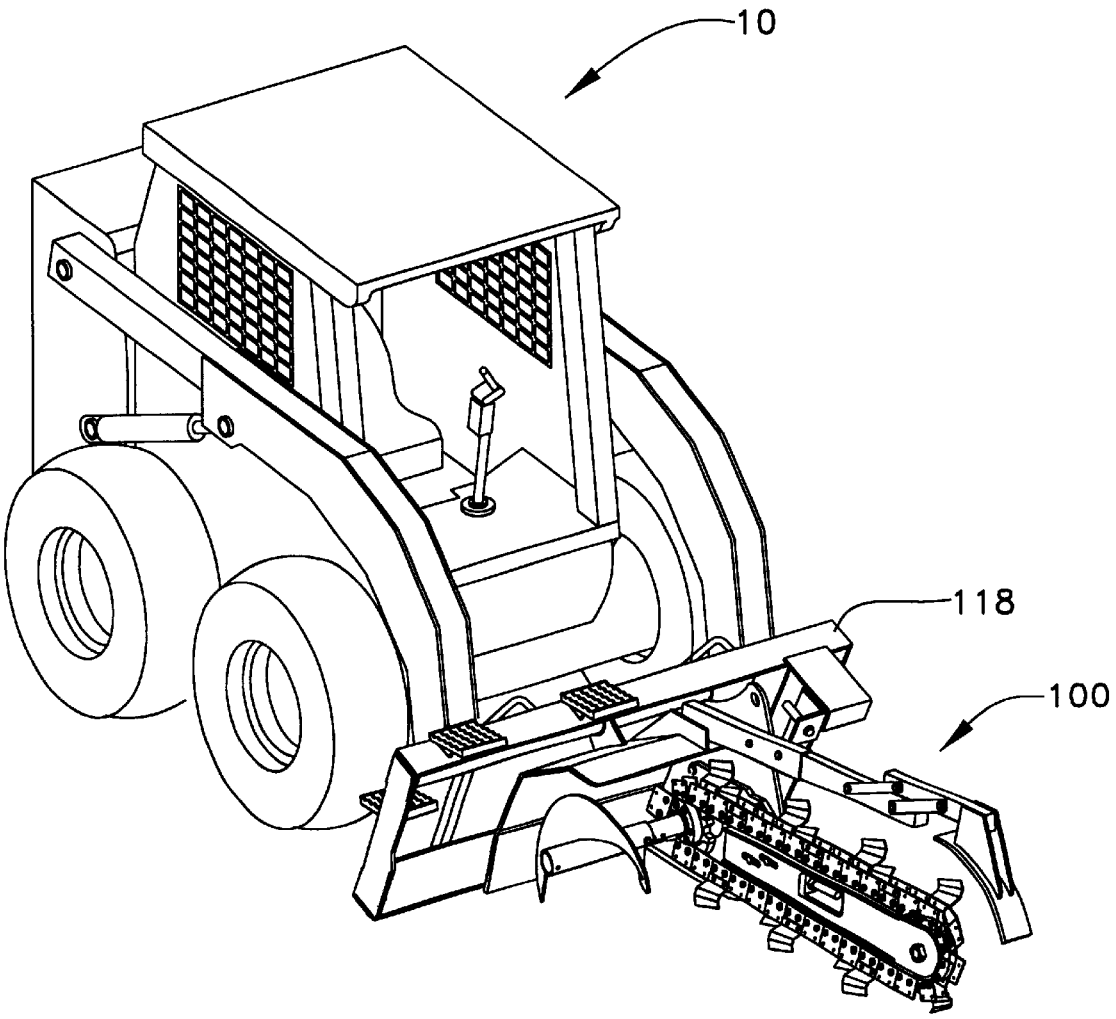
FIG. 1 is a partial side view of a work machine mounting the present invention trencher assembly.

While the invention is susceptible to various modifications and alternative forms, a specific embodiment thereof has been shown by way of example in the drawings and will herein be described in detail. It should be understood, however, that there is no intent to limit the invention to the particular form disclosed, but on the contrary, the intention is to cover all modifications, equivalents, and alternatives falling within the spirit and scope of the invention as defined by the appended claims.

Referring to FIG. 1, a work machine 10, such as a skid steer loader, is shown incorporating the present invention. The work machine 10 includes a frame 24 with front and rear end portions 28,32 supported by a plurality of wheels 36. The frame 24 includes left and right upright tower assemblies, one of which is shown at 42, that are positioned on the rear end portion 32 thereof. A cab 44 is mounted on the frame 24 for partially enclosing an operator (not shown) within an operating compartment 48. Left and right liftarm assemblies, one of which is shown at 60, are pivotally mounted to the respective corresponding left and right tower assemblies 42 for movement between lowered and raised positions. A pair of any suitable type of lift actuators, one of which is shown at 86, are used to lower and raise the liftarm assemblies 60.

An attachment, such as a trencher assembly 100, is connected to the frame 24 of the work machine 10 through a coupler (not shown) attached to the liftarm assemblies 60. It should be understood that the trencher assembly 100 may be directly or indirectly attached to the coupler (not shown) or the frame 24 of the work machine 10 by one or more of a plurality of connecting means, one of which is shown at 118. The connection of the trencher assembly 100 to the work machine 10 should be of any well known design that allows for movement of the trencher assembly 100 between a plurality of positions.

Figure 2:
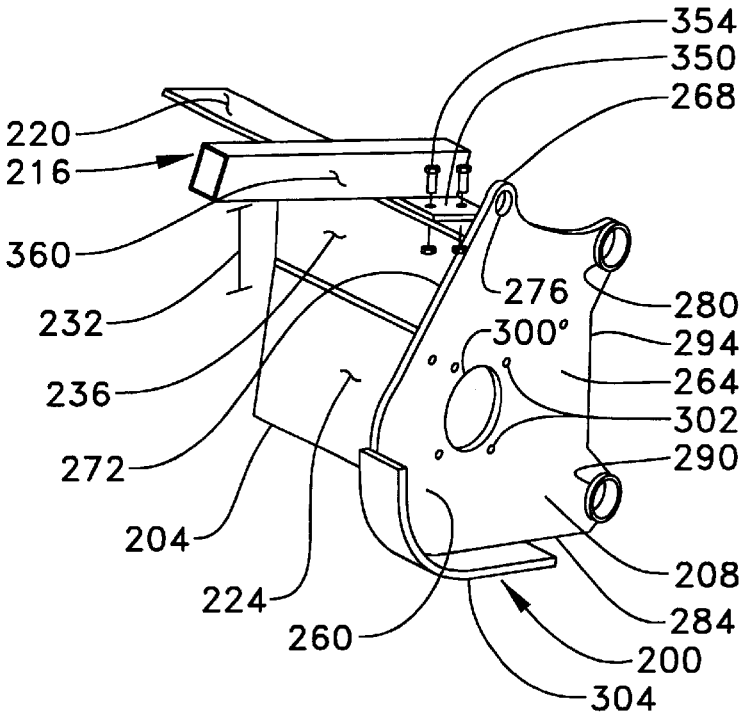
FIG. 2 is an perspective view illustrating a frame of the present invention.
Figure 3:
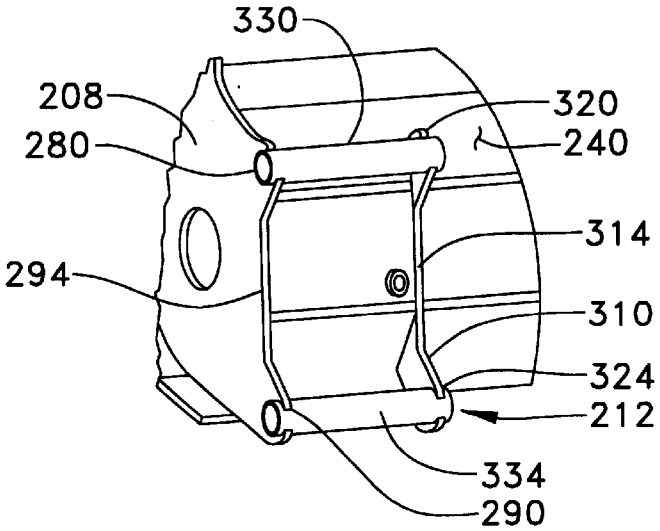
FIG. 3 is a partial rear view of the frame for the present invention.

As seen throughout most of the drawings, but more particularly in FIGS. 2 and 3, the trencher assembly 100 includes a frame assembly 200. The frame assembly 200 consists of a shroud plate 204, a main support plate 208, a slider assembly 212, and a bar assembly 216.

The shroud plate 204 has upper and lower walls 220,224. The upper wall 220 is bent at an angle from the lower wall 224 to define a large open area 232 adjacent the shroud plate 204. It should be understood that the lower wall 224 may also be bent to form a slight C shape with the upper wall 220. The shroud plate 204 has front and rear surfaces 236,240. The support plate 208 is connected in any suitable manner, such as welding, at an inner surface 250 (seen in FIG. 4) to one end of the shroud plate 204 so that the support plate 208 is substantially perpendicular with the shroud plate 204. The support plate 208 has an irregular outer shape with a curved front portion 260 that extends substantially between the upper and lower walls 220,224 at the front surface 236 of the shroud plate 204. A rear portion 264 of the support plate 208 extends rearwardly from the shroud plate 204 for termination at three distinctive corners. The first corner is an arcuate shaped tab 268 that is positioned upwardly and rearwardly from the front portion 260 through an angled front wall 272. A defined opening 276 extends through the support plate 208 at the arcuate tab 268. The second corner is an arcuate notch 280 that is positioned rearwardly from the front portion 260 through a planar bottom wall 284. The third corner is an arcuate notch 290 positioned rearwardly from the tab 268 and substantially in line (in a vertical plane) and in a spatial relationship with the notch 280 through a rear wall 294. A motor mounting opening 300 extends through the front portion 260 of the support plate 208 at a substantially midpoint between the upper and lower walls 220,224 of the shroud plate 204. A plurality of connecting openings, one of which is shown at 302, extend through the support plate 208 and surround the motor mounting opening 300. A curved alignment plate 304 is connected in any suitable manner, such as welding, to the front portion 260 of the support plate 208 and extends along a portion of the front and bottom walls 272,284.

The slider assembly 212, seen best in FIG. 3, includes a mounting plate 310 connected in any suitable manner, such as welding, to the rear surface 240 of the shroud plate 204 a spaced distance from the support plate 208 and substantially parallel therewith. The mounting plate 310 has a rear wall 314 with a substantially identical shape to the rear wall 294 of the support plate 208 including a pair of spaced apart notches 320,324, each coaxially aligned with the respective notches 280,290, respectively, in the support plate 208. Each one of a pair of support tubes 330,334 are connected in any suitable manner, such as welding, within the respective coaxially aligned notches 320,280 and 324,290 for extension between the mounting plate 310 and the support plate 208.

The bar assembly 216 includes an attachment plate 350 releasably mounted through a plurality of bolts, one of which is shown at 354, to the angled upper wall 220 at the rear surface 240 of the shroud plate 204. A hollow bar 360 is connected in any suitable manner, such as welding, to the attachment plate 350 and extends forwardly away from the machine 10 and along the front surface 236 of the shroud plate 204 a predetermined distance.

Figure 4:
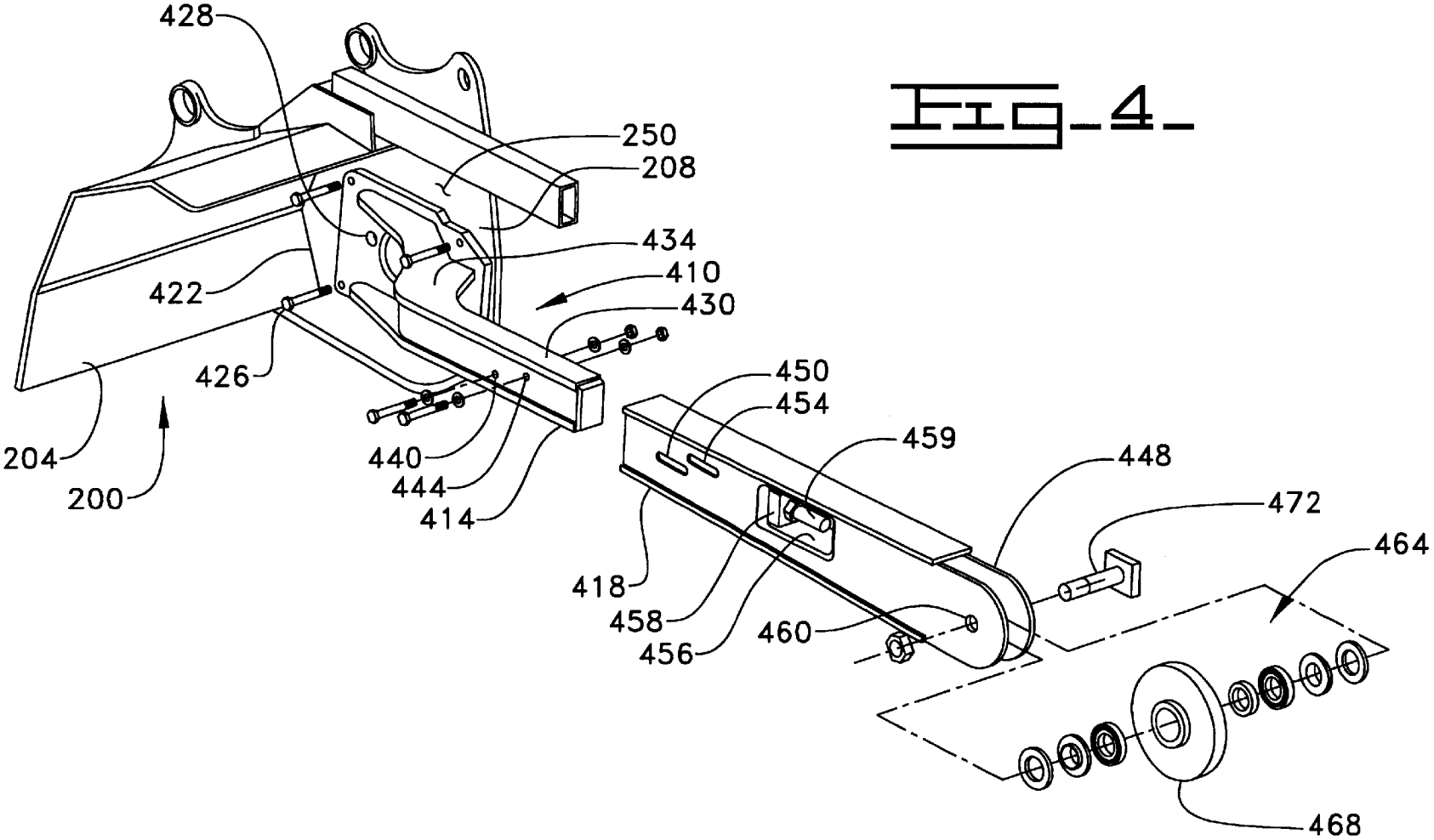
FIG. 4 is an exploded perspective view illustrating a boom arm of the present invention and the boom arm's connection with the frame.

Referring particularly to FIG. 4, a pivotable boom arm assembly 410 is shown as a part of the trencher assembly 100. The boom arm assembly 410 consists of a mounting portion 414 and an elongated supporting portion 418. The mounting portion 414 includes a mounting plate 422 connected in any suitable manner, such as through bolts, one of which is shown at 426, to the inner surface 250 of the support plate 208. A plurality of openings, one of which is shown at 428, extend through the mounting portion 414 and are coaxially aligned with the connecting openings 302 in the support plate 208. An elongated arm 430 is connected to the mounting plate 422 at an offset portion 434 in any suitable manner, such as welding. The offset portion 434 defines a spatial relationship between the inner surface 250 of the support plate 208 and the arm 430. A pair of spaced openings 440,444 extend through the arm 430. The supporting portion 418 has a box-like shape of conventional design with a bifurcated end portion 448. A pair of slotted openings 450,454 extend through the supporting portion 418. The supporting portion 418 is slidingly disposed over the arm 430 opposite the bifurcated end portion 448 and adjustably connected in any suitable manner, such as through bolts used in a well-known manner, one of which is shown at 449, through the openings 440,444 in the arm 430 and the slotted openings 450,454 in the supporting portion 418. A large opening 456 extends through the central region of the supporting portion 418. A tensioning device 458 of any suitable design is disposed in a well known manner within the opening 456 and includes a tensioning screw 459. The boom arm 410 extends outwardly from the frame 200 away from the machine 10 in a spatial relationship with and substantially parallel to the bar assembly 216 for central alignment thereof. An opening 460 extends through the supporting portion 418 at the bifurcated end portion 448. An idler assembly 464 of conventional design has an idler 468 and is connected at the bifurcated end portion 448 in any suitable manner, such as through a bolt assembly 472 extending through the opening 460.

Figure 5:
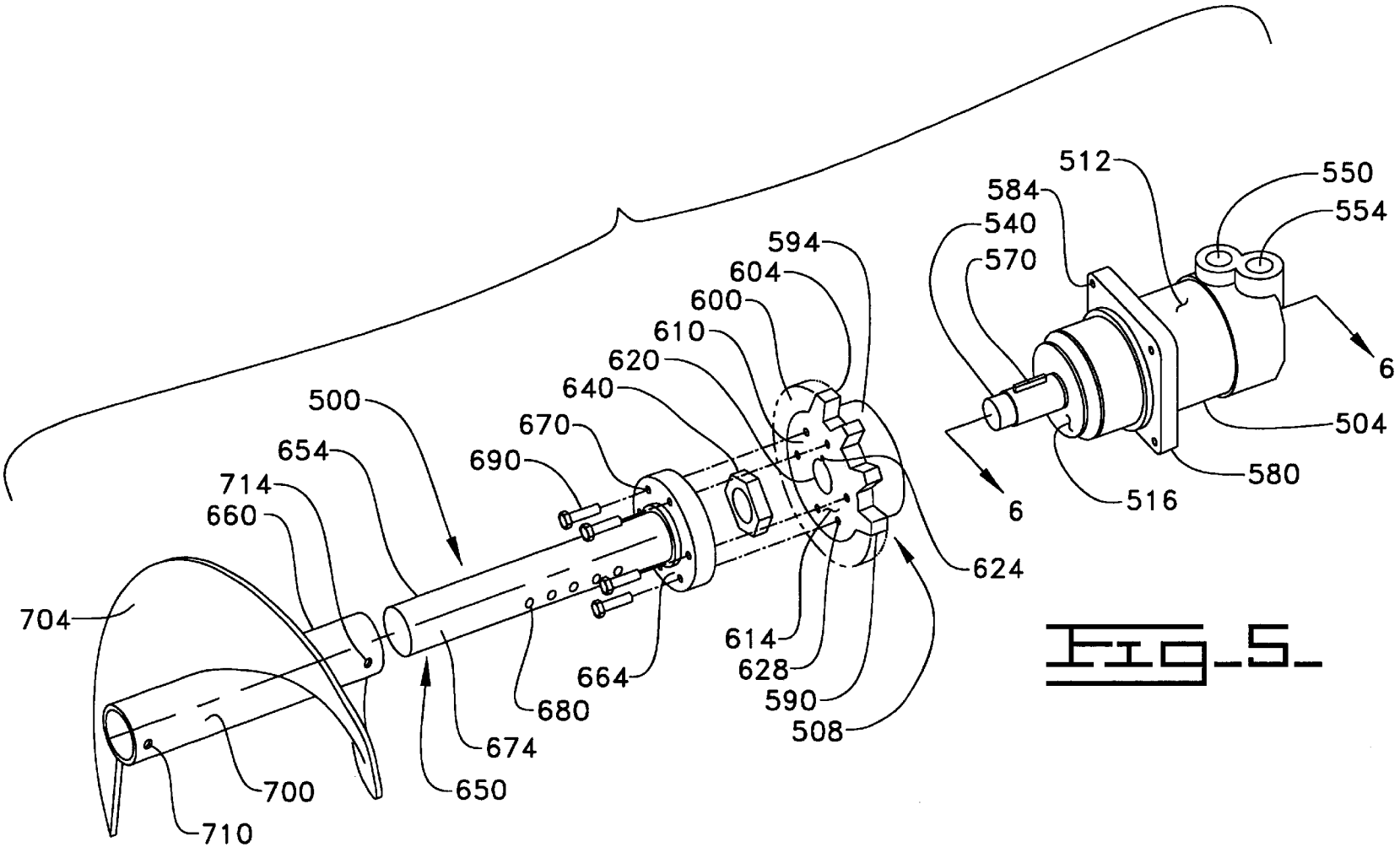
FIG. 5 is an exploded perspective view illustrating a drive train of the present invention featuring a motor and a sprocket in cooperation with an auger assembly.
Figure 6:
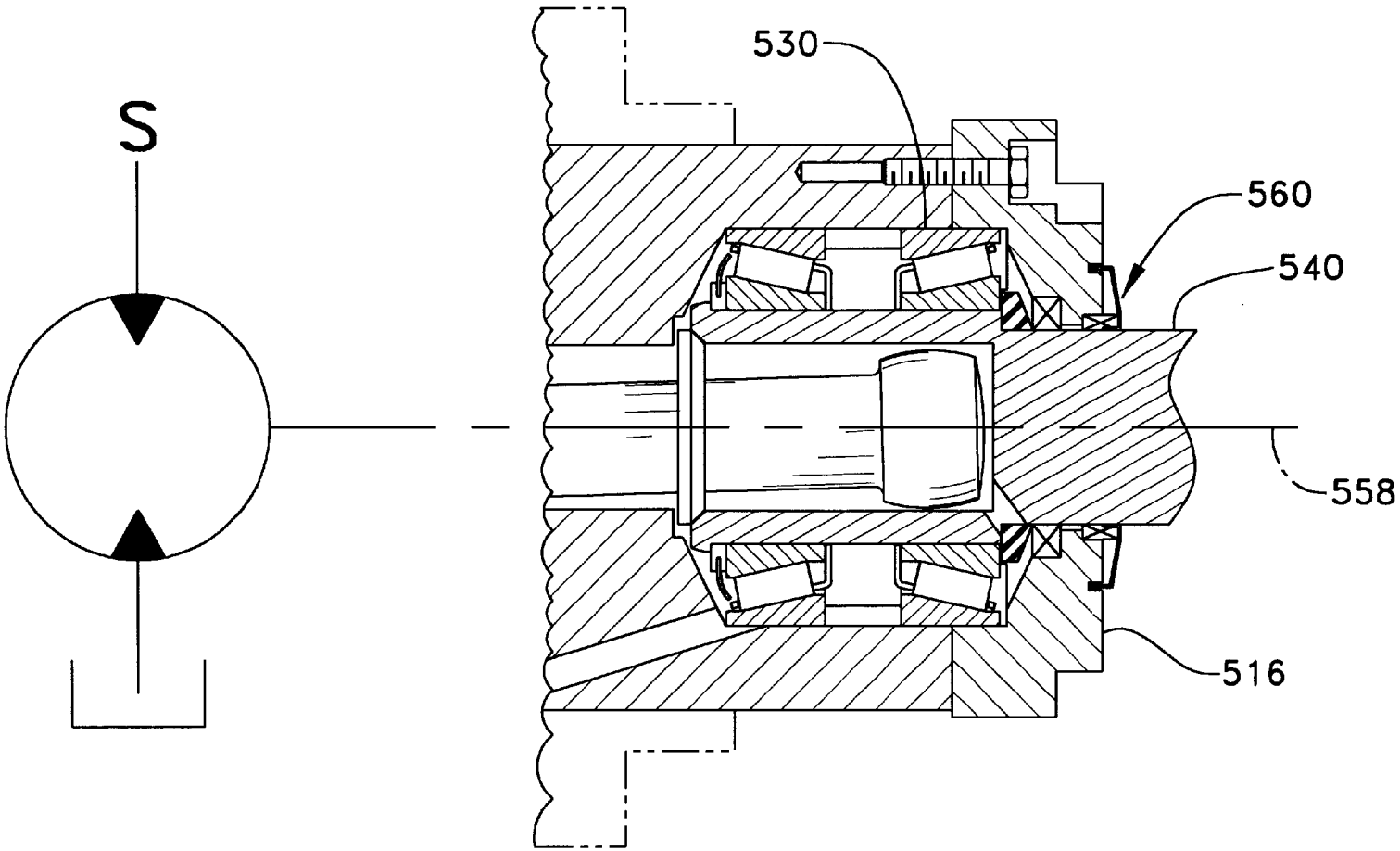
FIG. 6 is a sectional view of the motor taken along line 6—6 in FIG. 5.
Figure 7:
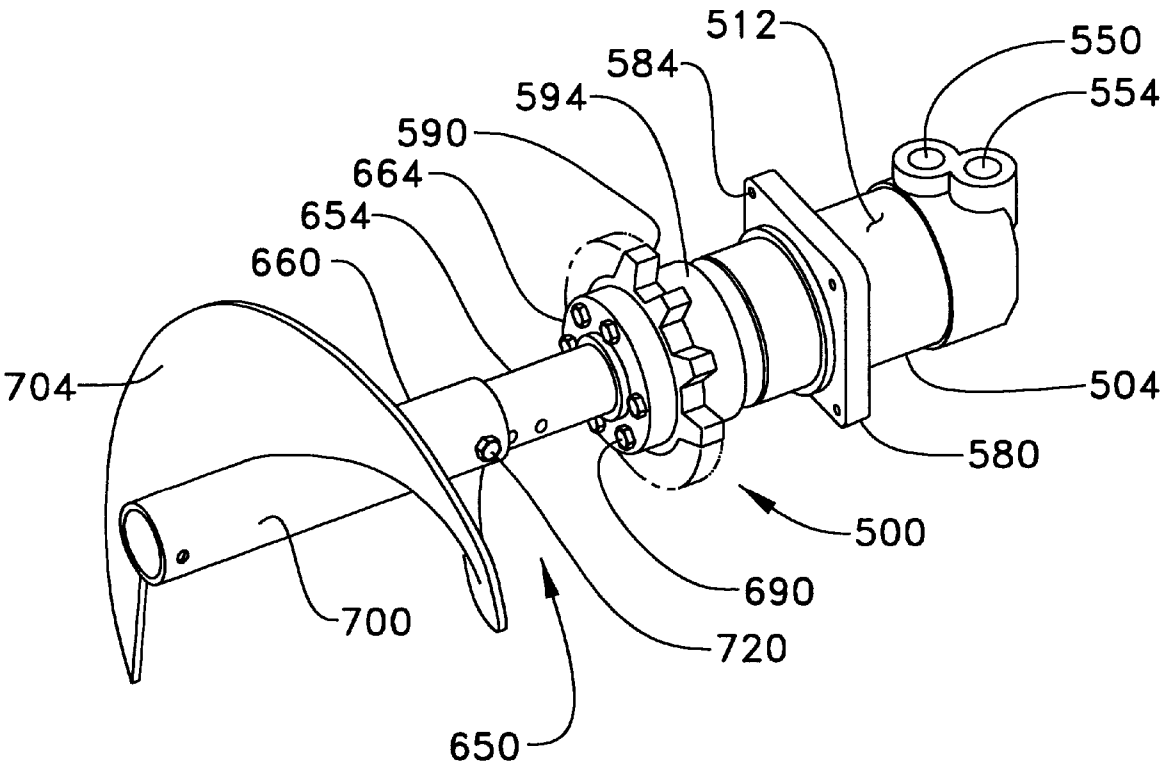
FIG. 7 is a perspective view of the present invention with the motor, sprocket and auger assembly connected.

A drive train assembly 500, seen in FIGS. 5–7, consists of a fluid driven motor 504 and sprocket 508. Looking first at FIGS. 5–6, the motor 504 is of a conventional hydraulic design and includes a housing 512 with a front face 516 that encompasses a bearing assembly 530. The bearing assembly 530 circumferentially surrounds a tapered shaft 540 in a well-known manner. As seen in FIG. 9, a rearward portion of the motor 504 extends through the motor mount opening 300. As seen best in FIG. 8, the forward portion of the motor 504 lies adjacent the offset portion 434 of the arm 430 so that the shaft 540 lies within the open area 232 of the shroud plate 204. The motor 504 is driven hydraulically from a hydraulic fluid source (S) via openings 550,554 disposed in the motor 504. It should be understood that the motor 504 may be driven in any other suitable manner, such as electrically, mechanically, and the like. The driving forces of the motor 504 are imparted to rotate the shaft 540 via the bearing assembly 530 in a well-known manner. The shaft 540 has a longitudinal axis 558 perpendicular with the front face 516 of the housing. The shaft 540 extends through an opening in the front face 516 of the housing 512 and terminates at an external location. Sealing means 560, which may include a plurality of operatively associated seals, is disposed at the intersection between the front face 516 of the housing 512 and the shaft 540 to isolate the bearing assembly 530 within the housing 512, as seen best in FIG. 6. A key 570 is connected to the shaft 540 in a conventional manner and extends along the shaft's surface at an elevated level. A motor mount plate 580 is cast as a portion of the housing 512 and includes a plurality of mounting openings therethrough, one of which is shown at 584. As seen in best in FIGS. 8–9, the motor 504 is connected on the mounting plate 422 adjacent the inner surface 250 of the support plate 208 via a plurality of fasteners (not shown) extending through the aligned openings 584,428,302 in the motor mount plate 580, mounting plate 422 and the support plate 208, respectively.

The sprocket 508 includes integral gear and hub portions 590,594, respectively. The gear portion 590 has an outer region 600 including a plurality of uniformly spaced teeth 604 positioned therearound. An inner region 610 of the gear portion 590 has a planar surface 614. A shaft opening 620 extends through the inner region 610 of the gear portion 590 at a central location thereof. A keyway 624 is cut within the shaft opening 620. A plurality of openings, one of which is shown at 628, extend through the inner region 610 and are positioned equidistant and circumferentially around the shaft opening 620. As seen best in FIGS. 5 and 7, the sprocket 508 is slidingly disposed over the shaft 540 of the motor 504 with the key 570 of the shaft 540 aligned within the keyway 624 of the sprocket 508. The sprocket 508 is held on the shaft 540 in any suitable manner, such as through a locking nut 640. The assembly of the sprocket 508 on the shaft 540 of the motor 504 positions the hub portion 594 circumferentially around the shaft 540 and the sealing means 560. Further, the assembly of the sprocket 508 on the shaft 540 ensures that a distance is maintained between the bearing assembly 530 in the motor 504 and the sprocket 508 that coaxially aligns the outer region 600 of the gear portion 590 with the boom arm 410.

Referring to FIGS. 5 and 7, an auger assembly 650 is shown that includes a mounting arm 654 and an auger 660. The mounting arm 654 consists of a mounting cover plate 664 with a plurality of openings, one of which is shown at 670 therethrough. An elongated rod 674 extends a predetermined distance from the cover plate 664. A plurality of openings, one of which is shown at 680, extend through the rod 674 along the length thereof. The mounting cover plate 664 has an hollow interior region (not shown). The mounting arm 654 is releasably connected to the sprocket 508 through a plurality of bolts, one of which is shown at 690, that extend through the openings 670,628. The hollow interior region (not shown) of the cover plate 664 encompasses the locking nut 640 when the mounting arm 654 is connected to the sprocket 508. The auger 660 is of a conventional design with a tubular connector 700 and blade 704. A pair of openings 710,714 extend through the tubular connector 700 at opposing ends thereof. The tubular connector 700 is slidingly disposed over the rod 674, as seen best in FIG. 7, and connected in any suitable manner, such as a bolt 720 through the aligned openings 714,680. It should be understood that the opening 710 allows the tubular connector 700 to be disposed over the rod 674 in a reverse manner to accomplish the assembly.

Figure 8:
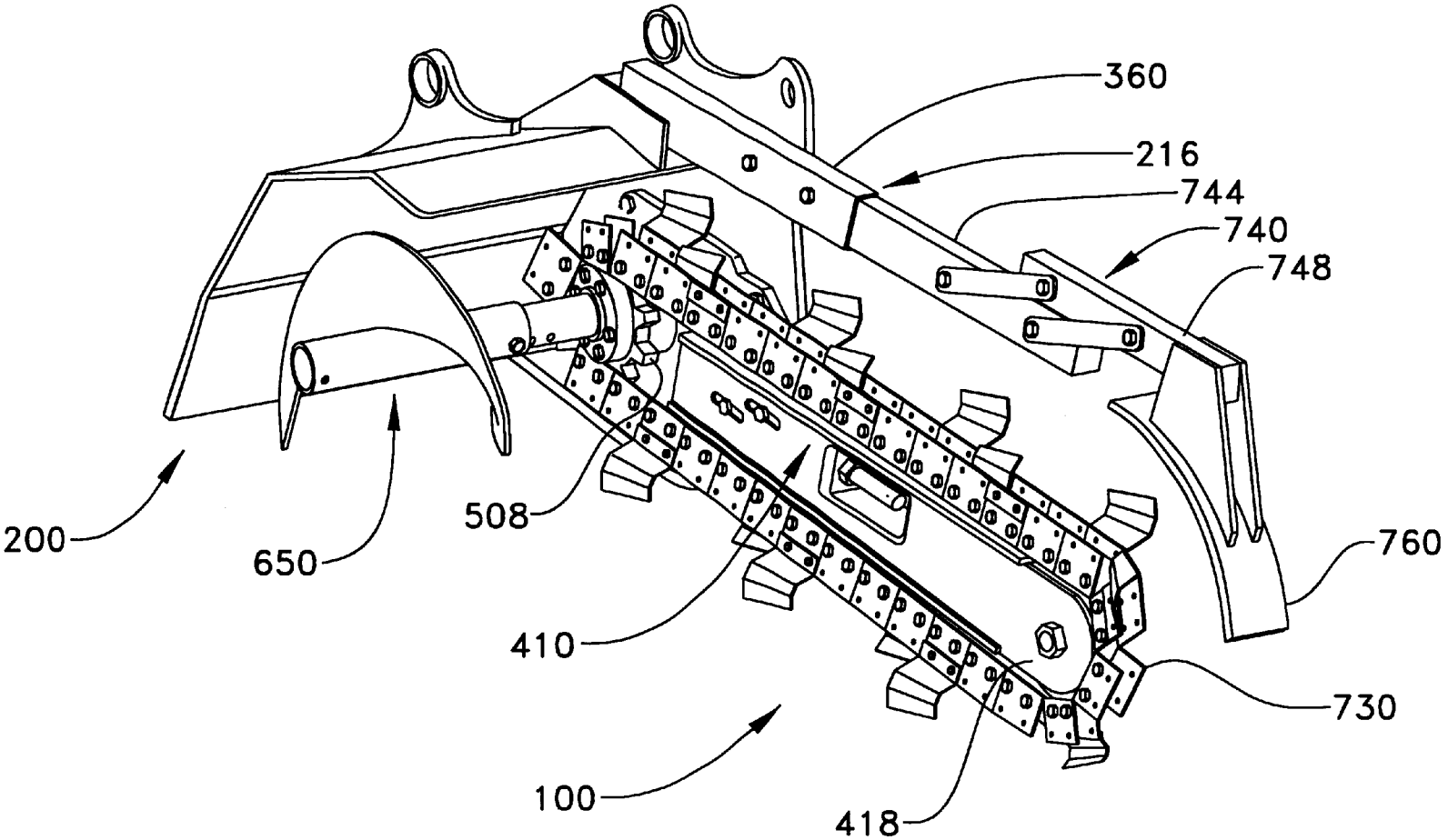
FIG. 8 is a perspective view illustrating the final assembly of the present invention.
Figure 9:
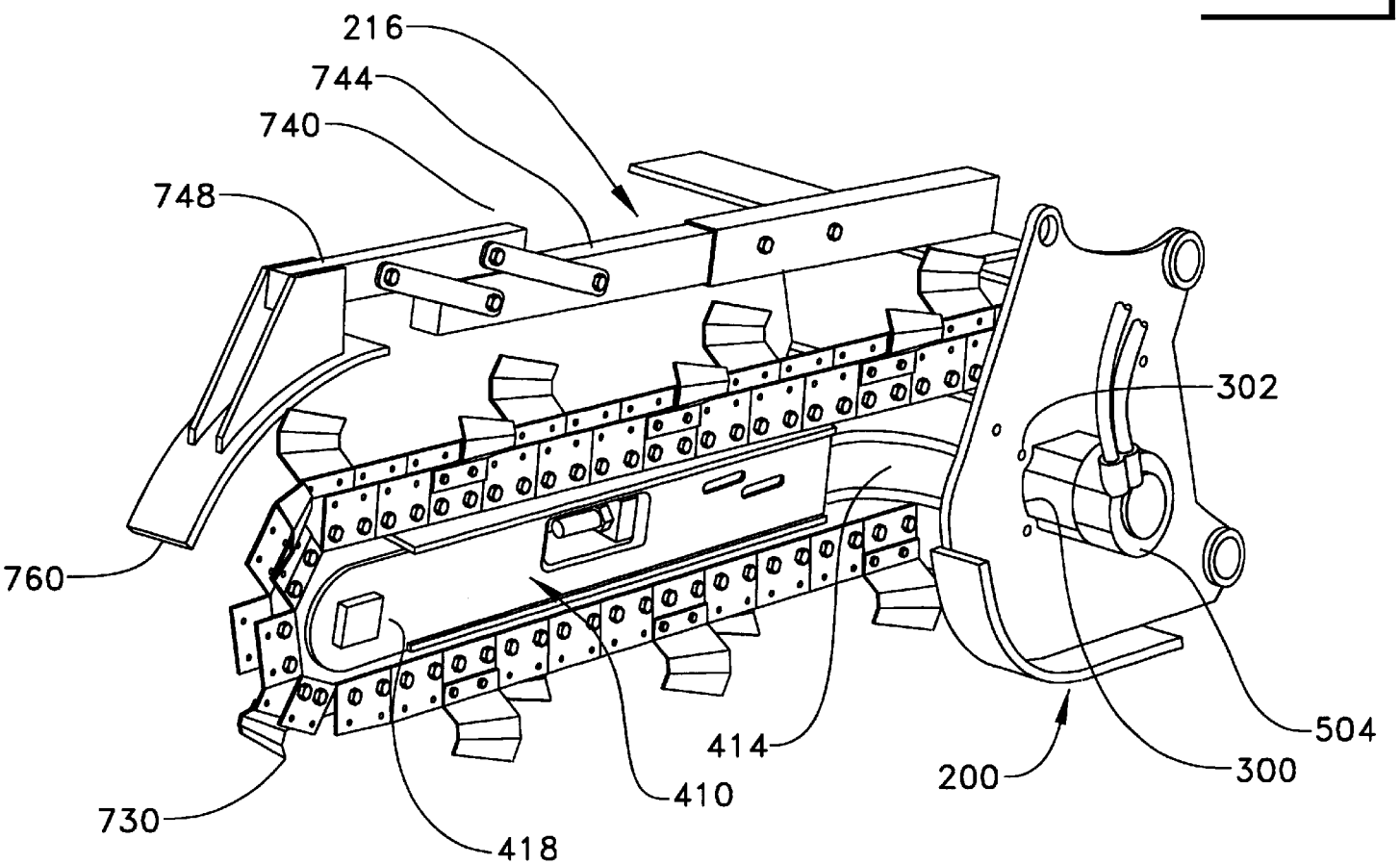
FIG. 9 is a perspective view taken at an different angle from FIG. 8 illustrating the final assembly of the present invention.

Referring more specifically to FIGS. 8–9, a digging chain 730 of conventional design is rotatably connected between the boom arm 410 and the sprocket 508. The digging chain 730 interfaces the outer region 600 of the gear portion 590 by connection with the plurality of teeth 604 and encircles the boom arm 410 at the supporting portion 418 around the idler 468. The digging chain 730 is tensioned in a well known manner utilizing the adjustment capability between the mounting portion 414 and supporting portion 418 and the tensioning device 458. A crumber assembly 740 includes a elongated slider tube 744 and a crumber 748 connected in any suitable manner, such as bolting, to the slider tube 744. The connection between the crumber 748 and the slider tube 744 must be sufficiently loose to minimize stress on the bar assembly 216. The slider tube 744 is slidingly disposed within the hollow region of the bar 360 so that the crumber assembly 740 and the bar assembly 216 may be releasably connected in any suitable manner, such as by bolting. The crumber 748 has a curved plate 760 at the end opposite the connection between the crumber assembly 740 and the bar assembly 216. The crumber assembly 740 is parallel and spaced upwardly from and extends forwardly beyond the digging chain 730 so that the curved plate 760 cleans the bottom of the trench during the digging operation.

INDUSTRIAL APPLICABILITY

During operation, the shaft 540 is rotated when hydraulic fluid from the source (S) is supplied to the motor 504 in a well known manner. The rotation of the shaft 540, in turn, directly drives the sprocket 508. The driving forces on the sprocket 508 induces the gear portion 590 to drive the digging chain 730 through the connection at the outer region 600 around the teeth 604. Further, the driving forces on the sprocket 508 induces the gear portion 590 to drive the auger assembly 650 through the connection at the inner region 610. The driving forces imparted from the gear portion 590 to the digging chain 730 and auger assembly 650 occurs simultaneously, driving the digging chain 730 and auger assembly 650 in unison.

The alignment plate 304 acts as a pivot point for the trencher assembly 100 to allow for depth adjustment of the digging chain 730 into the ground when rotated via the dump function of the work machine 10. The trencher assembly 100 may be removed as a unit from the work machine 10 with a lifting device (not shown) utilizing opening 276 and surrounding structure.

The utilization of a fluid driven motor 504 provides for the enclosure of the bearing assembly 530 within the housing 512. The isolation of the bearing assembly 530 within the housing 512 through the use of the sealing means 560 protects the bearing assembly 530 from dirt and other debris. The internal motor bearing assembly 530 negates the usage of an external bearing, which is prone to damage by dirt and debris, or an internal bearing used within a component separated from the motor 504, such as a hub assembly.

Additionally, the internal motor bearing assembly 530 is more closely located to the sprocket 508 to provide a shorter moment arm for greater strength capabilities by keeping the loads on the bearing assembly 530 low. Further, the motor 504 provides a direct drive for the sprocket 508, eliminating the necessity for additional gearing, belts, rotating support structure, and the like. The ability to eliminate additional components provides for a more compact trencher assembly 100.

The integration of the gear and hub portions 590,594 of the sprocket 508 further reduces the components in the trencher assembly 100. The hub portion 594 is used to provide a spacer between the gear portion 590 and the motor 504 to establish the shorter moment arm. Therefore, it should be understood that the hub portion 594 may vary in length to accommodate the desired configuration. It should also be understood that the offset portion 434 of the boom arm assembly 410 may also be varied to accommodate for additional spacing between the gear portion 590 and the motor 504. Additionally, the hub portion 594 circumferentially surrounds a portion of the motor 504, to protect the shaft 540 and the sealing means 560 from damage and debris. The protection by the hub portion 594 increases the life of the shaft 540 and the sealing means 560. It should be understood that the profile of the teeth 604 on the gear portion 590 must have adequate relief so that dirt may easily pass around the sprocket 508 for substantial removal by the auger 660.

Other aspects, objects and advantages of this invention can be obtained from a study of the drawings, disclosure and the appended claims.

What is claimed is:

1. A trencher assembly, comprising:

a frame;

a boom arm connected on the frame;

a motor connected on the frame, the motor having a rotatable shaft;

a sprocket connected directly on the shaft of the motor, the sprocket being directly driven by the motor through the rotation of the shaft;

a digging chain connected between the boom arm and the sprocket, the digging chain being driven by the rotation of the sprocket; and an auger assembly connected with the sprocket for rotation therewith in unison with the digging chain.

2. The trencher assembly of claim 1, wherein the sprocket includes a gear portion and a hub portion, the gear and hub portions being integral.

3. The trencher assembly of claim 1, wherein the motor is a fluid driven design having a housing circumferentially surrounding an internal portion of the shaft.

4. The trencher assembly of claim 1, wherein the auger assembly includes a mounting arm connected to the sprocket for rotation therewith and an auger connected on the mounting arm.

5. The trencher assembly of claim 2, wherein the hub portion circumferentially surrounds a portion of the motor.

6. The trencher assembly of claim 3, wherein at least one bearing assembly is located within the housing of the motor adjacent the shaft for operation therewith and a predetermined distance is defined between the at least one bearing assembly and the sprocket.

7. The trencher assembly of claim 4, wherein the sprocket includes a gear portion having an outer region with a plurality of teeth positioned uniformly therearound and a inner region with a planar surface and a hub portion, the digging chain being connected on the outer region of the gear portion about the plurality of teeth and the mounting arm of the auger assembly being connected to the inner region of the gear portion at the planar surface thereof.

8. The trencher assembly of claim 6 wherein the shaft of the motor has a longitudinal axis, the housing of the motor has a front face perpendicular to the longitudinal axis of the shaft, a sealing means is located at an intersection between the front face of the housing and the shaft to isolate the at least one bearing assembly within the housing, a portion of the shaft is external from the housing and extends a predetermined distance from the front face opposite the at least one bearing assembly, and the sprocket is mounted on the external portion of the shaft and includes a gear portion and a hub portion integral with the gear portion.

9. The trencher assembly of claim 8, wherein the hub portion circumferentially surrounds a portion of the motor that includes the external portion of the shaft and the sealing means.

10. A trencher assembly having a pivotable boom arm connected to a work machine, a digging chain rotatably connected on the boom arm, and an auger assembly, comprising:

an enclosed drive train assembly including a motor with a rotatable shaft and a sprocket for simultaneously driving the digging chain and auger assembly in unison, the sprocket being connected directly on the shaft of the motor and directly driven by the motor through the rotation of the shaft; and the sprocket including a gear portion and a hub portion integral with the gear portion.

11. The trencher assembly of claim 10, wherein the hub portion circumferentially surrounds a portion of the motor.

* * * * *